US005549246A

United States Patent [19]

Kukesh

[11] Patent Number: 5,549,246

[45] Date of Patent: Aug. 27, 1996

[54] EXTERNAL MIX APPLICATION SYSTEM AND NOZZLE ASSEMBLY

[75] Inventor: Timothy S. Kukesh, Indianapolis, Ind.

[73] Assignee: Glas-Craft, Inc., Indianapolis, Ind.

[21] Appl. No.: 375,262

[22] Filed: Jan. 19, 1995

Related U.S. Application Data

[63] Continuation of Ser. No. 137,491, Nov. 19, 1993, abandoned, which is a continuation-in-part of Ser. No. 968,004, Oct. 26, 1992, abandoned.

[51] Int. Cl.[6] ..... B05B 1/28; B05B 7/08

[52] U.S. Cl. ..... 239/9; 239/105; 239/296; 239/419.3; 239/422

[58] Field of Search ..... 239/9,105,294,296,299,419.3, 239/422,424.5, 425, 552, 556, DIG. 8

[56] References Cited

U.S. PATENT DOCUMENTS

| | | | |
|---|---|---|---|
| 2,271,779 | 2/1942 | Peeps | 239/296 |
| 2,646,314 | 7/1953 | Peeps | 239/296 |
| 3,335,956 | 8/1967 | James | 239/8 |
| 4,187,983 | 2/1980 | Boyer | 239/9 |
| 4,618,098 | 10/1986 | Hedger, Jr. et al. | 239/290 |
| 4,824,017 | 4/1989 | Mansfield | 239/9 |
| 4,854,504 | 8/1989 | Hedger, Jr. et al. | 239/294 |
| 4,948,053 | 8/1990 | Hufgard | 239/296 X |
| 5,080,283 | 1/1992 | Kukesh et al. | 239/9 |

FOREIGN PATENT DOCUMENTS

| | | |
|---|---|---|
| 0038481 | 12/1983 | European Pat. Off. . |
| 3417229A1 | 11/1985 | Germany . |
| 55-94662 | 7/1980 | Japan . |
| 184988 | 9/1963 | Sweden . |

*Primary Examiner*—Andres Kashnikow
*Attorney, Agent, or Firm*—Brinks, Hofer, Gilson & Lione

[57] ABSTRACT

In an external mix, plural component application system, a first component material, such as a resin, is formed into a plurality of small, spaced streams arranged in a two-dimensional array and projected generally at a substrate or article. A second component material, such as a catalyst, is formed into two air-entrained sprays of second component material and directed at the plurality of small, spaced streams of the first component material from adjacent the opposite sides of the array of streams to assist atomization of the small, spaced streams into particles of first component material and to mix the plural components. A plurality of flows of compressed air are directed at the substrate or article from adjacent the opposing sides of the array of streams that are between the two sprays of second component material and provides containment of plural component emissions. A second plurality of flows of compressed air at lower flow rates are directed forwardly of a nozzle assembly to inhibit an accumulation of the plural component material on the face of the nozzle assembly.

32 Claims, 5 Drawing Sheets

EXTERNAL MIX APPLICATION SYSTEM AND NOZZLE ASSEMBLY

RELATED APPLICATIONS

This application is a continuation of application Ser. No. 08/137,491 filed Nov. 19, 1993, now abandoned, which is a continuation-in-part of U.S. patent application Ser. No. 07/968,004 filed Oct. 26, 1992, now abandoned.

FIELD OF THE INVENTION

The present invention relates generally to multi-component application systems and, more particularly, to a contained external mix plural component application system and method.

BACKGROUND ART

Multi-component application systems have been used, for example, in manufacturing plastic articles by applying resinous materials to a mold or preform for an article, or to pre-arranged fiber reinforcing materials, or with fiber reinforcing materials as they are being applied.

In multi-component spraying systems, a liquid resin and a catalyst for the resin are formed into spray particles directed onto a substrate where the catalyst and resin react and harden to form the article. In such applications, the resin and catalyst components are preferably mixed together, and the mixture is sprayed onto the substrate. For example, in manufacturing articles with polyester resin, a catalyzing agent for the polyester resin is mixed with the resin, and the resin-catalyst mixture is then applied to the substrate. In internal mix systems, the resin and catalyst are mixed within the spraying apparatus, and the mixture is then atomized by a spray nozzle and directed onto the substrate. In external mix systems, the resin and catalyst are mixed externally of the apparatus after the resin and catalyst have already been atomized. In both external mix and internal mix systems, complete and thorough mixing of the resin and catalyst is important to avoid non-uniform hardening of the resin on the substrate and other undesirable results. Multi-component materials have also been used, for example, in the manufacture of insulating foams by mixing and spraying the components of a foam-producing combination onto a substrate where they produce a hardened foam-like coating.

U.S. Pat. No. 4,824,017 discloses a method and apparatus that includes a flow of compressed air and entrained catalyst particles directed at the expanding, fan-like, resin film closely adjacent the airless nozzle, that effectively mixes catalyst particles with resin particles formed from an airless resin nozzle, and that provides a small, compact spray pattern with uniformly distributed and mixed resin and catalyst that may be easily used by an operator to deposit a uniform film of plural component material onto a substrate. U.S. Pat. No. 4,824,017 discloses that finely atomized spray particles are not a specific desideratum, not being necessarily required in the manufacture of articles from plural component spraying systems, and that such articles are generally provided with smooth surfaces by the substrates, molds or preforms upon which the plural component materials are deposited and cured, and that it is desirable that the spray particles remain large enough so that their surface areas are small compared to their masses and they retain their fluidity so they may flow out on a substrate, mold or preform upon deposition. This retention of fluidity also enhances the ability of the catalyst spray particles to mix with and cure the resin particles upon deposition.

In one disclosed embodiment of U.S. Pat. No. 4,824,017, an airless liquid nozzle of generally conventional design (in that it includes an internal passageway terminating at an internal hemispherical surface which is cut through by an external, V-shaped groove to form an elongated, elliptical-shaped, liquid orifice) forms a flow of resin into an expanding fan-like film. A nozzle assembly is positioned around and adjacent to the liquid nozzle and comprises an annular chamber terminated at its forward end by an internal, generally hemispherical-shaped surface which is also cut through by an external, V-shaped groove to form an elongated, elliptical-shaped, air-catalyst orifice. The design and location of the air-catalyst orifice forms a flow of compressed air and catalyst particles which is generally juxtaposed around the fan-like film of resin at the liquid orifice and which includes a greater mass flow of compressed air and catalyst at the edges of the fan-like film at which resin "tails" exist. The flow of compressed air and catalyst will, therefore, provide preferential assistance in the atomization of the resin "tails" and the mixing of catalyst and resin to provide a spray in which the resin particles are of more uniform size and in which the catalyst carried by the compressed air flow will be more uniformly mixed with the resin particles throughout the volume of the spray.

In another disclosed embodiment of U.S. Pat. No. 4,824,017 a pair of flows of catalyst entrained in compressed air is directed at the planar surfaces of an expanding film of resin from the opposite sides thereof to impinge upon the expanding resin film a fraction of an inch forwardly of the liquid orifice and a pair of compressed air flows is directed forwardly and generally parallel to each other and to the spray axis to impinge upon the expanding sides of the resin film forwardly of the impingement of the compressed air and catalyst on the expanding resin film. Surprisingly, when compressed air is directed at the expanding edges of the fan-shaped resin film downstream of the impingement of the compressed air and catalyst upon the expanding liquid film, the uncontrolled billowing flow of air and escaping particles are eliminated. In addition, spray pattern size is reduced; and an improvement in spray pattern uniformity results without the creation of escaping atomized resin and catalyst particles characterized by prior air-assist, airless resin atomizing systems. The coaction of the flows of compressed air results in the capture of the resin and catalyst particles within the spray pattern.

European Patent No. 0,038,481 discloses a prior plural component application system where the flow of plural component material is divided into many small streams. In the system of European Patent No. 0,038,481, each of the streams tends to divide unpredictably and unreliably into segments of varying lengths, due to varying environmental factors and fluid flow characteristics, and the many streams of plural component material frequently create undesirable VOC emissions, that is, emissions of volatile organic solvent vapors, such as styrene vapors, into the workplace.

U.S. Pat. No. 5,080,283 discloses method and apparatus providing effective application from a plurality of small streams of mixed plural component material, with stabilized stream formation, division and application and with a substantial reduction of VOC emissions in plural component applications, such as gel coat and wet-out applications in the manufacture of reinforced fiberglass articles. The method and apparatus of U.S. Pat. No. 5,080,283 provide a compact, well defined and easily used pattern of plural component material with substantial containment of the plural component materials and reduced contamination of the work environment from, for example, an inexpensive, lightweight, easy-to-maneuver applicator, or an applicator with a fiber chopper.

In systems of U.S. Pat. No. 5,080,283, a flow of compressed air is delivered to an applicator and flows of the plural component materials are mixed and formed into a plurality of small, spaced streams extending from the applicator. The applicator includes a liquid nozzle for forming the mixed plural component material into a two-dimensional array of small, spaced streams extending from the liquid nozzle, and an air nozzle for directing a plurality of flows of compressed air generally parallel to the plurality of small, spaced streams from a plurality of passageways spaced about the liquid nozzle. The plurality of air passageways of the air nozzle are equally spaced from, and about, the liquid nozzle, on four sides thereof, and the passageways are surrounded by small cavities in the face of the air nozzle. The flow of compressed air is thus divided into a plurality of air flows that are directed about the plurality of small, spaced streams of plural component materials and generally adjacent and parallel to the streams. The plural component material streams are substantially confined by the air flows, and their break-up is stabilized and vaporous emissions are confined and reduced.

SUMMARY OF THE INVENTION

This invention provides an improved method and apparatus providing external mixing and application of plural component materials.

In the invention, a first component material, such as a resin, is formed into a plurality of small, spaced streams arranged in a two-dimensional array that are projected generally at a substrate or article; a second component material, such as a catalyst, is formed into two air-entrained sprays of second component material that are directed at the plurality of small, spaced streams of the first component material from adjacent opposite sides of the array of streams to break the small, spaced streams into particles of first component material that become mixed in the spray with particles of the second component material; and a flow of compressed air is formed into two flows of compressed air directed at the substrate or article from adjacent the opposing sides of the array of small, spaced streams and between the two sprays of the second component material, to provide containment for resin and catalyst vapors from the resin and catalyst particles.

In one preferred embodiment of the invention, the two-dimensional array of small, spaced streams comprises a plurality of rows of small, spaced streams of the first component material, with each row having a greater number of small, spaced streams and a greater row length than the number of rows and the height of the two-dimensional array. In addition, the two air-entrained sprays of second component material are preferably directed at the plurality of small, spaced streams from spray nozzles spaced on the opposite sides of the two-dimensional array formed by the ends of the rows and impinge on the plurality of small, spaced streams closely adjacent the sites of their projection, and the two flows of containment air are preferably directed at the substrate or article from passageways equally spaced from the two spray nozzles and centrally adjacent to the outermost rows of the small, spaced streams. In another preferred embodiment of the invention, an additional low flow of cleansing air is directed generally forwardly of the nozzle means from a plurality of orifices spaced about the two-dimensional array of small, spaced streams, and between the air-entrained second component spray nozzles and the containment air passageways, for inhibiting mixed plural-component material from accumulating on the applicator apparatus.

Other features and advantages of the invention will be apparent from the drawings and more detailed description that follows.

DETAILED DESCRIPTION OF THE DRAWINGS

Figure 2:
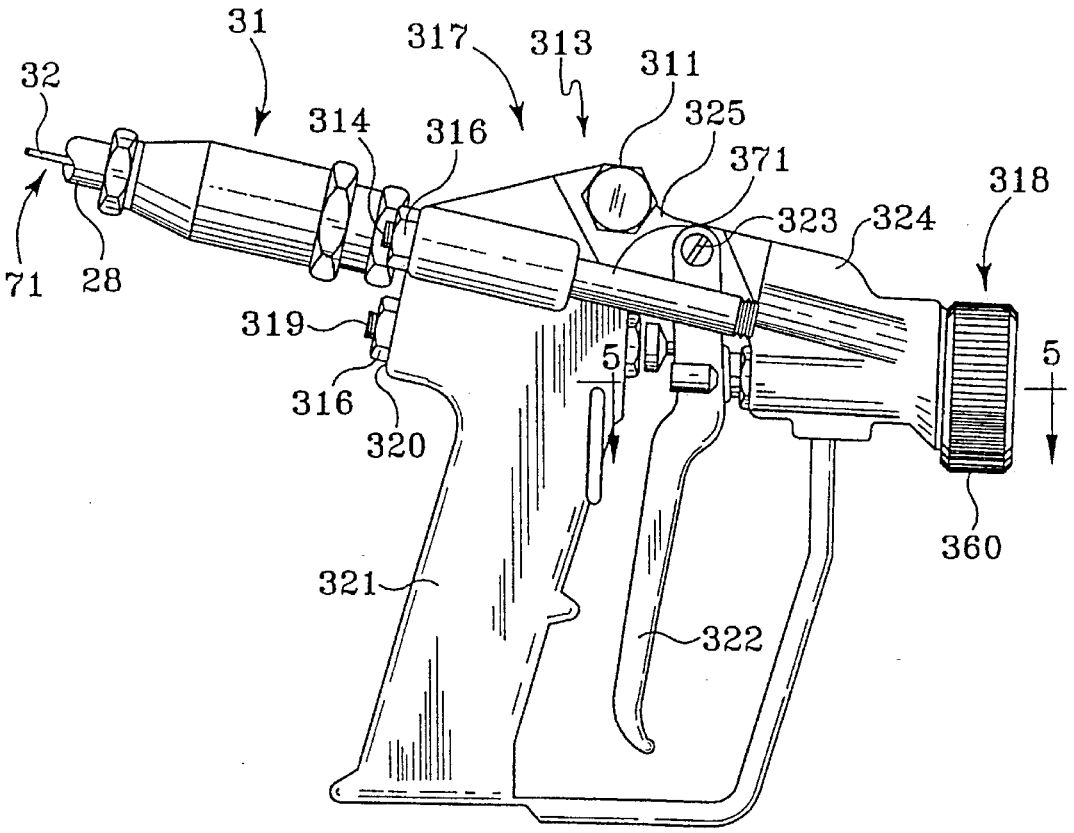
FIG. 2 is a side view of a plural component applicator including the invention.
Figure 3:
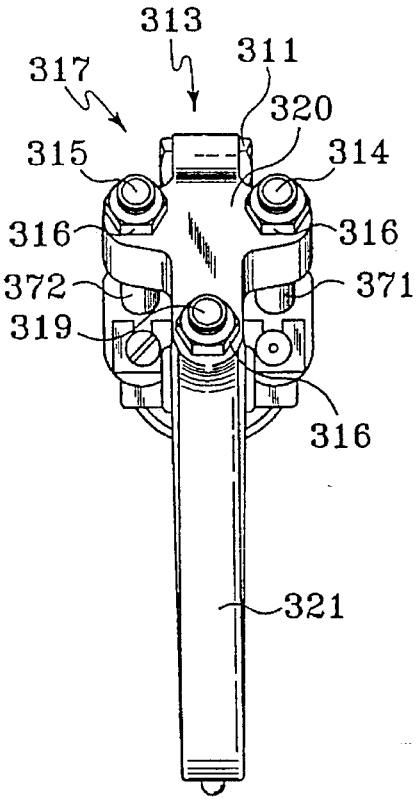
FIG. 3 is a back view of the applicator of FIG. 2.
Figure 4:
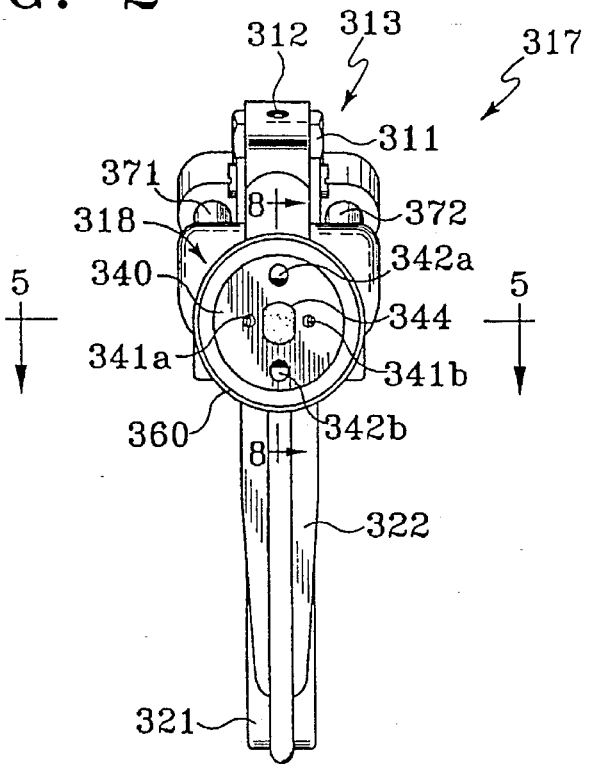
FIG. 4 is a front view of the applicator of FIGS. 2 and 3.
Figure 8:
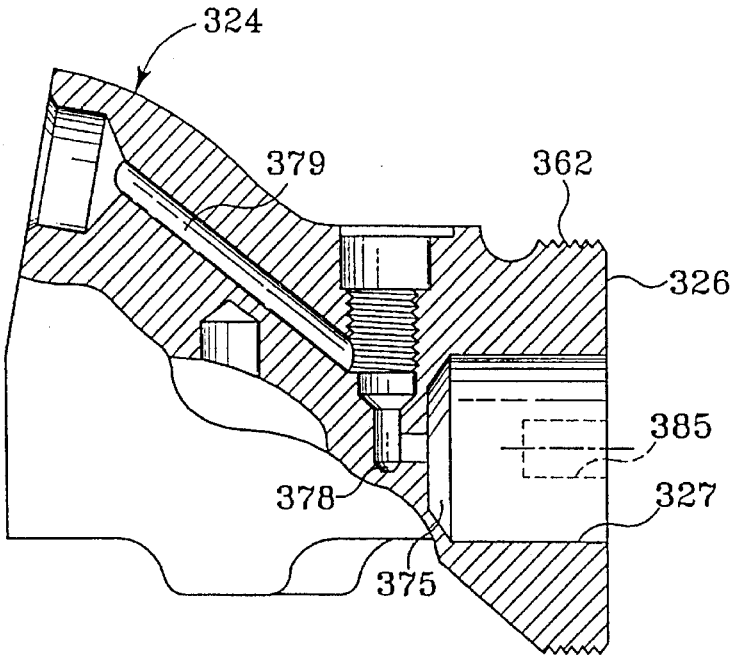
Figure 6A:
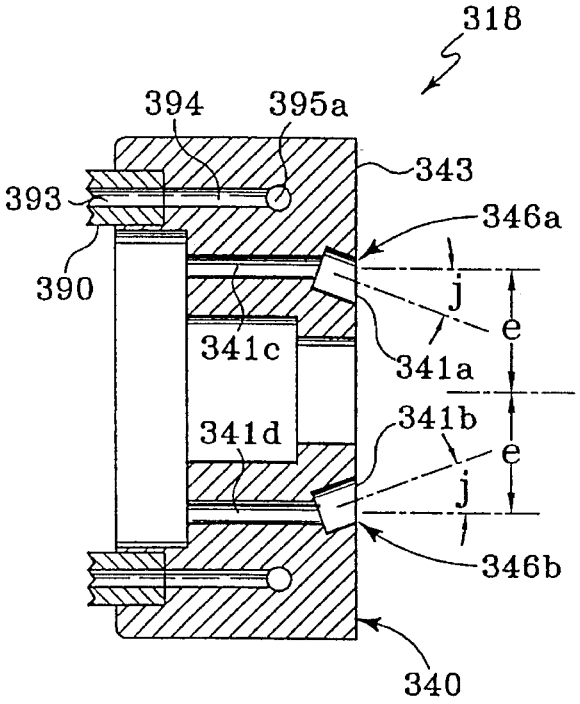
Figure 6B:
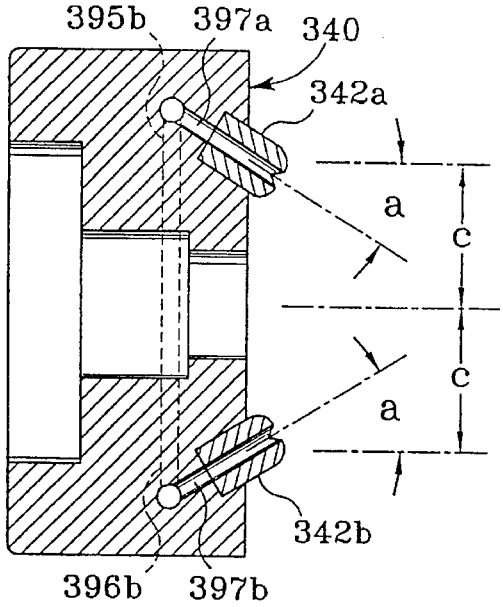
Figure 7:
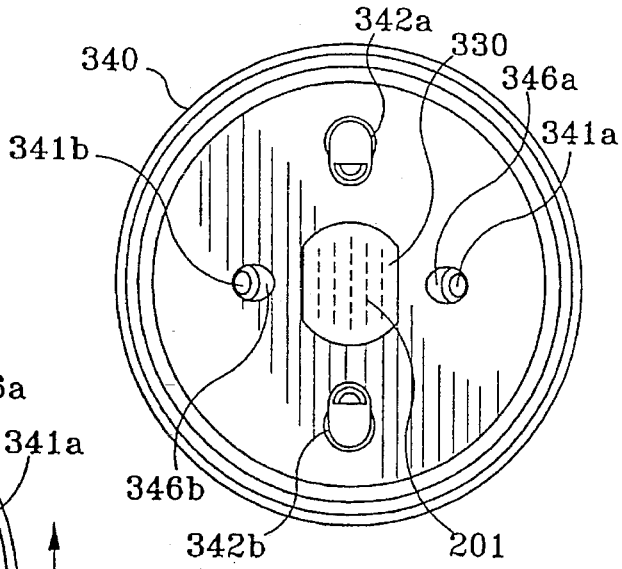
Figure 6C:
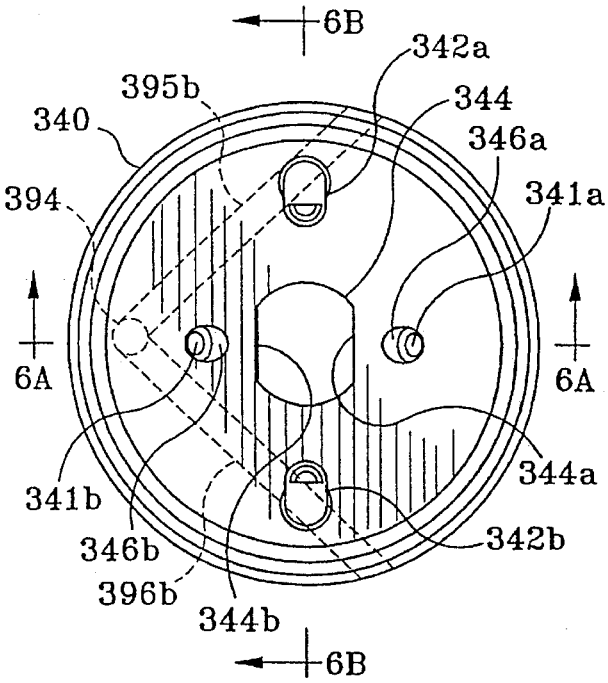
Figure 9A:
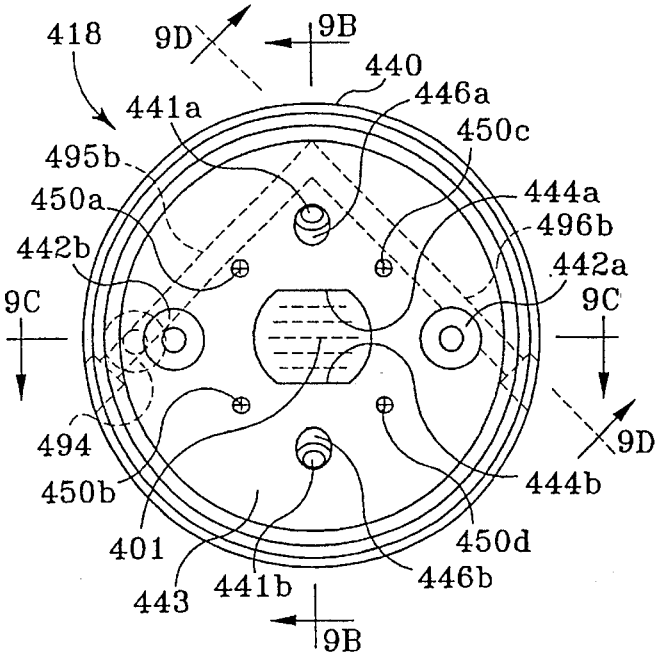
Figure 9B:
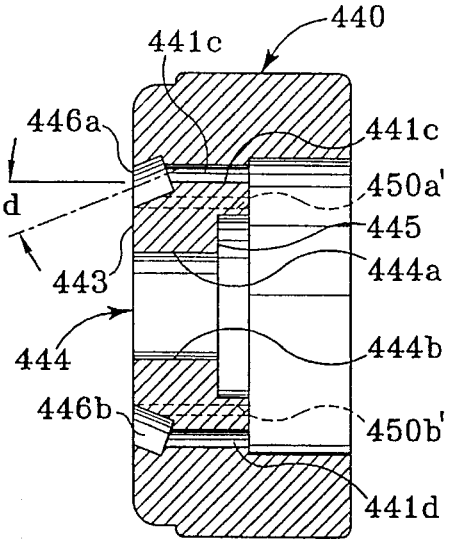
Figure 9C:
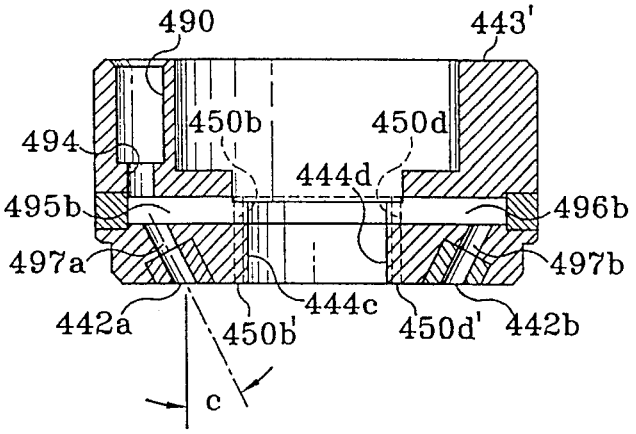
Figure 9D:
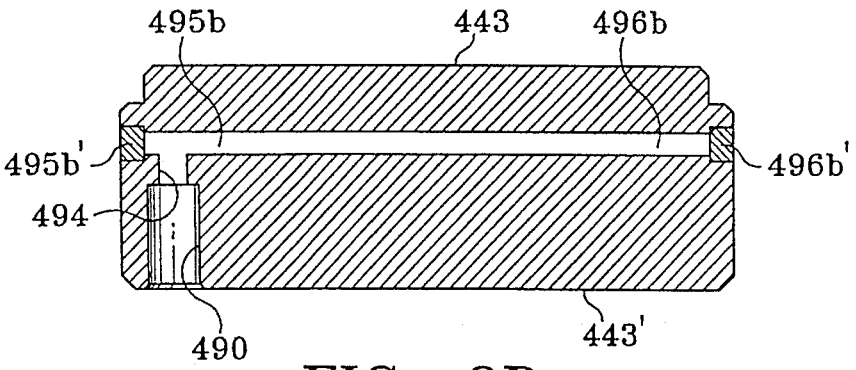

FIGS. 6A–C and 7 are drawings of a nozzle assembly of the applicator of FIGS. 2–5;

FIGS. 6A and 6B are a pair of orthogonal cross-sections of one part of the nozzle assembly taken at planes 6A—6A and 6B—6B of FIG. 6C, which is a front view of this nozzle assembly part;

FIG. 7 is a front view of the nozzle assembly;

FIG. 8 is another cross-section of the front portion of the applicator of FIGS. 2–5 taken at the central plane 8—8 of FIG. 4;

FIG. 9A is a front view of another nozzle assembly provided by the invention;

FIGS. 9B and 9C are a pair of orthogonal cross-sections of one part of the nozzle assembly of FIG. 9A taken at planes 9B—9B and 9C—9C, respectively, of FIG. 9A; and FIG. 9D is a section view of the nozzle assembly of FIG. 9A taken along reference line 9D—9D of FIG. 9A.

DESCRIPTION OF THE BEST MODE OF THE INVENTION

Figure 1:
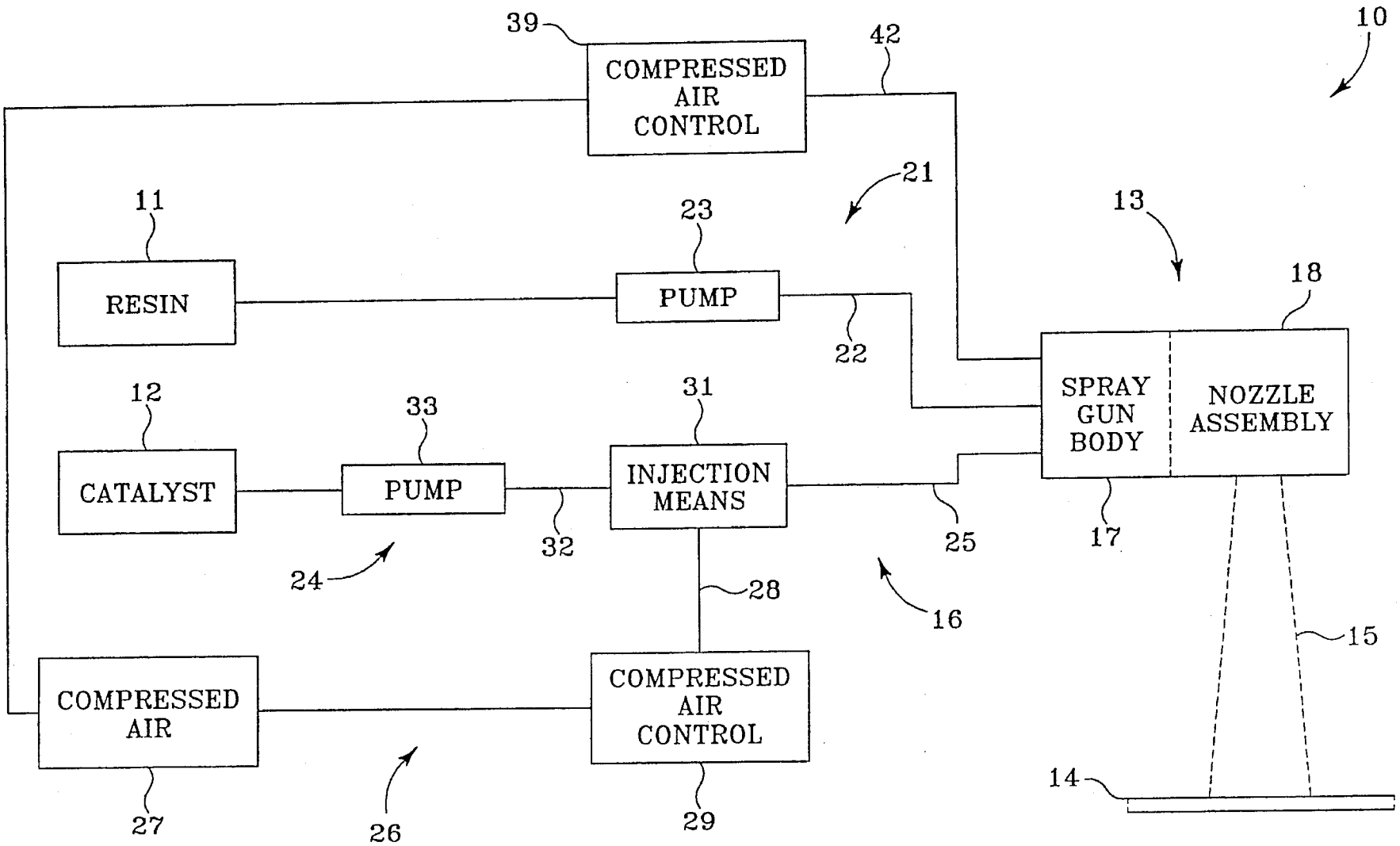
FIG. 1 is a block diagram to illustrate a system of the invention.

FIG. 1 schematically illustrates a system of the invention for the manufacture of fiber reinforced plastic articles, and FIGS. 2–4 illustrate a preferred embodiment of a hand-held applicator means 13.

The apparatus and method of this invention do not require a chopper; however, a chopper may be used to add reinforcing fiber to the plural component material, if desired. Where a chopper is used, the applicator means 13 may be fitted with a chopper by attaching it to the applicator body 17 by means of a bolt fastener (not shown).

In the system of FIG. 1 an external mix, air-assisted plural component application system is generally designated by reference numeral 10 and includes a first source 11 of a first component, e.g., a resinous material; a second source 12 of a second component, e.g., a catalyst for the resinous material; an application means 13 for mixing the catalyst and resin and for applying the mixture on a substrate 14; delivery means 16 for delivering the resin, catalyst and other materials to the spraying means during operation of the system; and a compressed air source 27.

Applicator means 13 preferably comprises a hand-held device (shown in FIGS. 2–4) which includes an applicator body 17 with a nozzle assembly 18, 418 at its front. Nozzle assembly 18, 418, includes two embodiments, one shown in FIGS. 5–7 and another shown in FIG. 9. Both embodiments are described in detail below and basically comprise a nozzle assembly in which compressed air and liquid pressure are used in applying the plural component material. Both embodiments 18, 418 comprise a first nozzle part 330 (FIGS. 5, 7 and 9A) for dividing a flow of mixed plural component material into a plurality of small, spaced streams and a second nozzle part 340, 440 (FIGS. 4, 6 and 9) for dividing a flow of compressed air into a plurality of directed air flows, and for dividing a flow of catalyst and compressed air into a plurality of directed catalyst-air sprays.

Delivery means 16 includes means 21 for delivering the resin under pressure to spraying means 13, including a resin pump 23 and resin conduit 22, arranged between the source of resin 11 and the applicator body 17; means 24 for delivering catalyst, including a catalyst pump 33 and a catalyst-air conduit 25, arranged between the catalyst source 12 and the applicator body 17; and means 26 for delivering a flow of compressed air for delivery of catalyst to the applicator, including a compressed air control 29 and an air conduit 28, arranged between compressed air source 27 and an injection means 31 for entraining the catalyst into the flow of air through conduit 25. Injection means 31 is shown and described in U.S. Pat. No. 3,763,876, the disclosure of which is incorporated herein by reference. Thus, system 10 includes a compressed air source 27; and delivery means 16 includes air delivery means 26 for delivering compressed air to the applicator means 13.

Catalyst from source 12 is delivered to applicator means 13 by introduction into the compressed air from source 27 that assists in the application of the material. Specifically, system 10 includes catalyst injection means 31, which receives catalyst under pressure from source 12 via conduit 32 and pump 33, and compressed air from source 27 via compressed air control 29 and conduit 28. Catalyst injection means 31 introduces the catalyst into the compressed air as a spray for delivery to the spraying means 13.

As described below, the flow of resin into spraying means 13 is directed through the liquid nozzle 330 which forms the resin flow into a plurality of small, spaced streams of resin in a two-dimensional array. The flow of catalyst-injected compressed air into spraying means 13 is directed at the plurality of resin streams through a plurality of spray nozzles, 342*a* and 342*b* (FIGS. 4, 6B, 6C and 7) and 442*a* and 442*b* in FIG. 9, which are configured and positioned so that the catalyst and compressed air will coact with the resin streams externally of the spraying means, simultaneously mix the resin and catalyst particles and assist in the application of the resin onto the substrate. In addition, the flow of compressed air alone is directed to a plurality of air nozzles, 341*a* and 341*b* (FIGS. 4, 5 and 7) and 441*a* 441*b* (FIG. 9). In another improved embodiment of the invention, an additional flow of compressed air is directed to a plurality of air orifices 450*a*–450*d* (FIG. 9) to inhibit collection of catalyst and resin on the apparatus.

Substrate 14 comprises an article-forming substrate such as a mold or preform used to manufacture articles from the catalyzed resin applied thereto. The invention can also be used to fill chambers of articles, such as refrigerators, with foam-like insulating materials. The resin can comprise any one of numerous materials such as a polyester or epoxy resin, and the catalyst can comprise any material suitable for catalyzing the resin. As noted above, system 10 may include a chopper mounted to spraying means 13 to dispense strands of fiberglass or the like into the spray pattern 15 to reinforce the plastic article and to act as a filler.

System 10 can further include a second compressed air control 39 connected to spraying means 13 by conduit 42. Compressed air from source 27 through control 39 provides the separate flow of air through air nozzles (341*a*, 341*b* and 441*a*, 441*b*) for assisting in containment of the catalyst and resin, and through air orifices (450*a*–450*d*) can be used for inhibiting the collection of catalyst and resin on the spraying means during a spraying operation.

FIGS. 2–4 illustrate one embodiment of a hand-held applicator means 13. The hand-held applicator means 13 preferably comprises a gun body 17 with a nozzle assembly 18 at its front. Gun body 17 and nozzle assembly 18 are described in substantially more detail below.

In use, applicator means 13 of FIGS. 2–4 is connected into the system shown in FIG. 1. The first source of the first component, i.e., the resinous material, is connected to the opening 314 at the rear of spray gun body 17. The resinous material from source 11 may then be provided by pump 23 through hose 22 to opening 314 at the rear of spray gun body 17. The second source 12 of the second component, i.e., the catalyst for the resinous material, is connected through pump 33, hose 32 and injection means 31 to opening 315 at the rear of spray gun body 17 (see FIG. 3). As shown in FIG. 2, injection means 31 may be conveniently attached to gun body 17 by threading it into opening 315 or onto a fitting 316 that is threaded into opening 315. Compressed air from compressed air source 27 is connected through the compressed air control 39 and a hose 42 to opening 319 at the rear of gun body 17. The upper rear portion of gun body 17 is provided with a mounting platform 320 (FIGS. 2 and 3) into which openings 314, 315 and 316 are perpendicularly drilled. When connected into system 10 of this invention, the connections for resin, catalyst and compressed air can be, thus, conveniently carried over the hand of the operator as he grips handle 321 formed in gun body 17.

Operation of the application system is effected by pulling the trigger means 322 which is pivotally fastened to gun body 17 by means of a threaded fastener 323. As the operator pulls trigger 322 rearwardly toward handle 321 of gun body 17, trigger 322 operates an air valve (not shown) located in the central plane of the spray gun body 17 rearwardly of trigger 322 and in a passageway leading from opening 319 to the interface between the forward position 325 of spray gun body 17 and head portion 324 (see FIG. 8 which illustrates the air passageways in the head portion 324). The trigger also operates a pair of valves for the resin and for the air-entrained catalyst located forwardly of the trigger in cavities 366 and 380 in the head portion 324 attached at the forward portion 325 of application means 13 (see FIG. 5).

In the operation of applicator means 13, catalyst from source 11 (FIG. 1) is delivered to application means 13 by its introduction into a second flow of compressed air from source 27. As indicated above and shown in FIG. 2, catalyst injection means 31 may be carried at the rear of spray gun body 17; the operative components of the catalyst injection means are, however, preferably incorporated into the spray gun body 17. Catalyst injection means 31 receives catalyst from source 12 as a result of the operation of pump 33, through conduit 32, and a controlled flow of compressed air from source 27 and compressed air control 29 through conduit 28. Catalyst injection means 31 introduces the catalyst into the compressed air for delivery to opening 315 at the rear of spray gun body 317. Catalyst injection means 31 is illustrated in U.S. Pat. No. 3,763,876 and its operation is described in detail therein.

In operation, applicator means 13 provides an expanded flow of mixed resin and catalyst which may be directed by the system operator onto a substrate 14, which may be a mold or preform used to manufacture articles of varied shape. When used without a chopper, applicator means 13 forms a smooth, catalyzed resin film on substrate 14. Such smooth, non-reinforced resin films are frequently referred to as being a "gel coat" and provide a smooth surface on the article. The nozzle assemblies shown in the drawings and described below may be utilized for applying "gel coat" with the means 13. If further strength is required in the manufactured article, means 13 may be operated with a chopper, as described above, to introduce, into the catalyst-resin spray, reinforcing fibers of selected length to form a layer of reinforced catalyzed resin deposited over the "gel coat" on the substrate. These fibers are preferably chopped fiberglass.

FIGS. 5–8 illustrate the head end 324 of the gun and nozzle assembly 18 attached to the head end of the gun 17.

Figure 5:
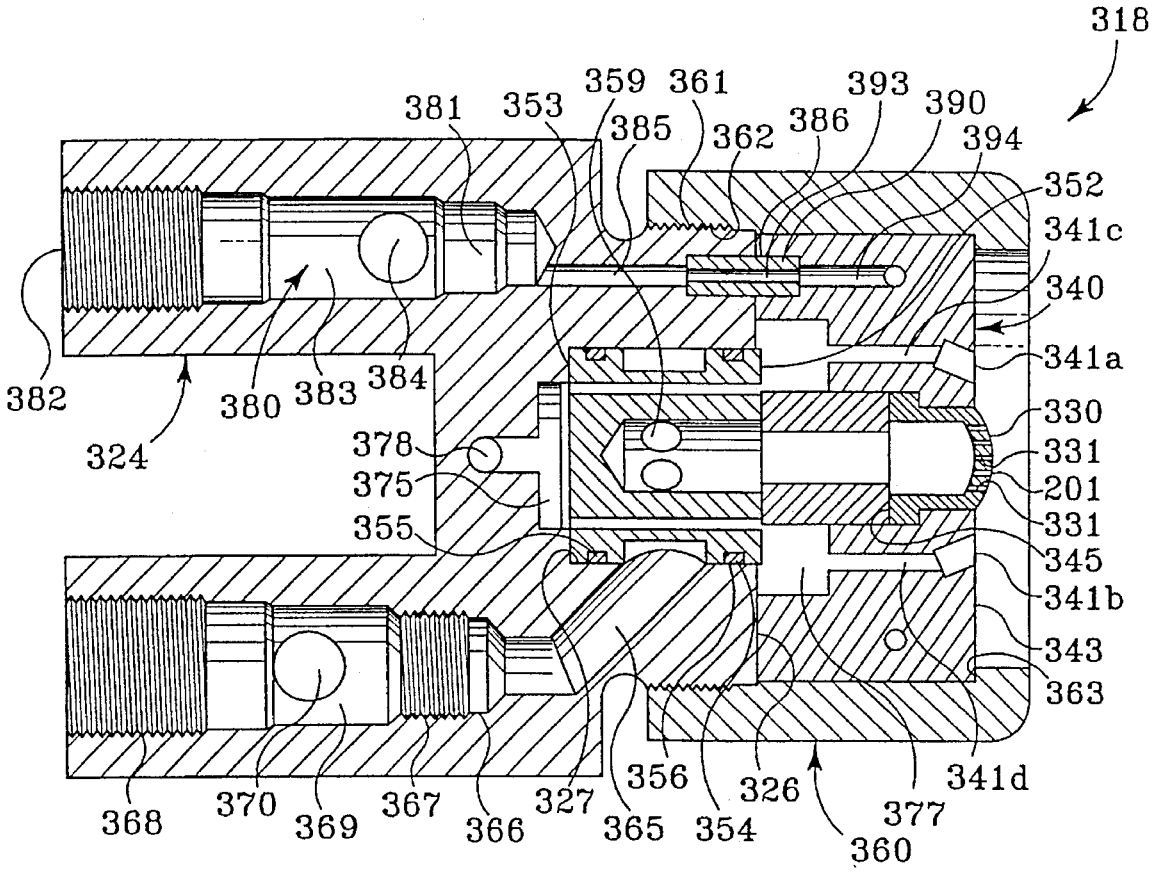
FIG. 5 is a cross-sectional view of the front portion of the applicator of FIGS. 2–4 taken at central plane 5—5 as indicated in FIGS. 2 and 4.

FIG. 5 is a cross-sectional view of the head end of 324 of the applicator means 13 with nozzle assembly 18 attached. The cross-sectional view of FIG. 5 is viewed downwardly on a plane through the center line of nozzle assembly 18 as indicated in FIGS. 2 and 4. Nozzle assembly 18 includes an airless liquid resin nozzle 330 and an air-catalyst nozzle 340. Liquid resin nozzle 330 includes a plurality of small spaced passageways 201 (FIG. 7) arranged in a two-dimensional array and forms the resin into a plurality of small spaced streams projected from the passageways 201. Air-catalyst nozzle 340 forms a controlled flow of air through a plurality of air orifices 341*a*, 341*b* and a controlled flow of catalyst entrained in air from a plurality of catalyst nozzles 342*a* and 342*b* (see FIGS. 6 and 7).

Nozzle assembly 18, including liquid resin nozzle 330 and air-catalyst nozzle 340, forms a resin-catalyst mixture having a pattern which provides a uniform distribution of particles throughout the pattern and without escaping catalyst particles. The pattern may be conveniently used by an operator of applicator means 13 to provide a uniform, catalyzed resin film on a substrate, mold or preform.

FIG. 5 shows how nozzle assembly 18 is assembled onto head portion 324 of spray gun body 17. As shown in FIG. 5, liquid resin nozzle 330 is held onto head portion 324 of the gun body by air-catalyst nozzle 340 and a threaded retainer nut 360. Retainer nut 360 includes a threaded portion 361 at its rear which threads onto a threaded portion 362 provided at the forward end of head portion 324. At its forward portion, retainer nut 360 forms an inwardly projecting flange 363 which engages the front face 343 of air-catalyst nozzle 340, urging nozzle 340 rearwardly and tightly against the front face 326 of head portion 324. Air-catalyst nozzle 340 is formed with a central opening 344 which is shaped to include two flat surfaces 344*a* and 344*b* (see FIGS. 4, 6C and 7). Opening 344 fits around liquid resin nozzle 330. A rearwardly facing flange 345 of nozzle 340 is formed around central opening 344; and as the retaining nut 360 is threaded onto the head portion 324 of the spray gun and its rearwardly facing flange 363 engages the front face 343 of air-catalyst nozzle 340 and urges the nozzle 340 rearwardly, flange 345 of nozzle 340 presses liquid resin nozzle 330 rearwardly into engagement with sealing means 333 and body portion 350.

As shown in FIG. 5, sealing means 333 is sealingly engaged between liquid nozzle 330 and body portion 350. Thus, as retaining nut 360 is threaded onto head portion 324 of the spray gun body, nut 360 simultaneously fastens the air-catalyst nozzle 340 and liquid resin nozzle 330 to the head portion 324 of the spray gun and provides an effective seal between liquid resin nozzle 330 and air-catalyst nozzle 340 and, by means of seal means 333, between liquid resin nozzle 330 and body portion 350.

Body portion 350 comprises a generally cylindrical-shaped component of aluminum or stainless steel having a central passageway 351 extending from its front face longitudinally into, but not through, its body. Body portion 350 also forms a pair of outwardly extending flanges 352 (forward) and 353 (rear) forming a pair of O-ring grooves 354 and 355 to carry a pair of O-rings 356 and 357 to provide a seal between body portion 350 and inner wall 327 that forms a central cavity in head portion 324 of the spray gun body. An annular cavity 358 is formed by the flanges 352 and 353 of the body portion between body portion 350 and inner wall 327 of head portion 324. A plurality of openings 359 is formed in body portion 350 extending between cavity 358 and central passageway 351.

When body portion 350 is held in place in the cavity formed in head portion 324 of the gun body by inner surface 327, the annular cavity 358 that it forms communicates with a passageway 365 formed in head portion 324. Passageway 365 extends rearwardly in head portion 324 and intersects a machined cavity 366 formed in the rear of head portion 324 and adapted to accept the elements of a resin valve (not shown). Cavity 366 thus includes a threaded portion 367 adapted to accept a valve seat having a threaded exterior. Valve cavity 366 further includes at the rear face of head portion 324 a threaded portion 368 adapted to accept the washers, packing elements and threaded compression nut necessary to provide (as known in the art) a compression packing and to seal around a needle valve actuator that extends longitudinally from trigger 322 along the center line of cavity 366 into engagement with a valve seat threaded into portion 367. With the valve seat positioned in threaded portion 367 and packing members in position in threaded portion 368, cavity 366 forms a central fluid cavity 369 which is in communication with a passageway 370 in head portion 324. Passageway 370 leads through a tube 371 (shown in FIGS. 2–4) to resin opening 314 (shown in FIGS. 2 and 4).

Thus, with pump 23 (FIG. 1) operating, pressurized resin is presented at opening 314 into passageway 370 through the tube 371. As long as trigger 322 is not being operated, the valve seat adjacent threaded portion 367 of cavity 366 in the head portion of the gun body is closed and there is no resin flowing through the gun body. When trigger 322 is pulled rearwardly, thereby removing the needle valve from the valve seat at threaded portion 367, resin flows under the influence of pressure imparted by pump 23 through passageway 370, cavity 369, passageway 365, annular cavity 358, openings 359, central passageway 351, liquid resin nozzle 330 and the openings 201 therein. As noted above, liquid resin nozzle 330 includes a plurality of interior passageways 331 to force the resin to flow into a plurality of small, spaced streams projected from the nozzle 330 in a two-dimensional array. FIG. 7 best shows the plurality of openings 201 and the two dimensional array formed by the plurality of passageways 331.

Body portion 350, when in place in the cavity formed in head portion 324 of the spray gun body 17, also forms an air passage to deliver a flow of compressed air to the plurality of air orifices 341*a* and 341*b* in the front of the air-catalyst nozzle 340. As best shown in FIG. 5, the central cavity of head portion 324 includes a rearward portion 375 having a smaller diameter than the cavity formed by inner wall 327 of head portion 324. Body portion 350 further includes a plurality of passageways 376, preferably four, extending forwardly from its rear face at the cavity 375 to adjacent its forward end where the plurality of passageways 376 opens into an annular cavity 377 formed between body portion 350, front face 326 of head portion 324 of the applicator and air-catalyst nozzle 340. A plurality of air passageways 341*c*, 341*d* (FIG. 6A) extends from the rear air-catalyst nozzle surface that communicates with annular cavity 377 to orifices 341*a* and 341*b* at the front face 343 of air-catalyst nozzle 340. Compressed air, which is controlled by a needle valve in gun body 17 rearwardly of trigger 322, is directed through passageways which are not shown in the gun body 17 from opening 319 (FIGS. 2 and 4) to the interface between head portion 324 and the front portion 325 of spray gun body 17. As shown in FIGS. 5 and 8, passageway 378 intersects a passageway 379 in head portion 324 which extends rearwardly to the interface between head portion 324 and the front portion 325 of gun body 17. When trigger 322 is operated, the compressed air flows from source 27 and compressed air control 39 (FIG. 1) through conduit 42, opening 319, the passageways in gun body 17 (not shown), passageway 379, passageway 378, cavity 375, the plurality of passageways 376, annular cavity 377, passageways 341*c* and 341*d* (FIGS. 5 and 6A) formed in air-catalyst nozzle 340 and from the plurality of air orifices 341*a* and 341*b*.

As shown in FIG. 5, the rear portion of head portion 324 of the gun body also forms a cavity 380 adapted to carry means to control the flow of air-entrained catalyst from applicator means 13. Cavity 380 includes a threaded portion 382 adjacent the rear face of head portion 324 adapted to carry a separate, self-contained needle valve assembly (not shown) with a needle valve actuator that extends from the trigger valve 322 within the self-contained needle valve assembly into engagement with a valve seat carried within the self-contained needle valve assembly. With needle valve assembly in place, cavity 380 forms a central cavity 383 which, as shown in FIG. 5, communicates with passageway 384. Passageway 384 extends upwardly through head portion 34 of the spray gun body and extends rearwardly through tube 372 shown in FIGS. 3 and 4 to opening 315 and catalyst injection means 31.

When trigger 322 is operated, the valve carried in cavity 380 of head portion 324 of the spray gun is opened and catalyst particles and air flow under the influence of catalyst pump 33, compressed air source 27 and compressed air control 29, through injection means 31, orifice 315 at the rear of the spray gun body 317, tube 372 (FIGS. 1, 3 and 4), passageway 384 and through passageway 385 to cavity 386 (FIG. 5). With air-catalyst nozzle 340 in the position shown in FIGS. 2–5, the air-entrained catalyst is directed into a passageway 393 in a tube 390 at the rear of the air-catalyst nozzle 340 and into air-catalyst passageway 394 in nozzle 340. FIG. 6C is a front view of the nozzle assembly 340 for gel coat applications showing the orientation, from a front perspective, of air-catalyst passageway 394. Air-catalyst nozzle 340 shown in FIGS. 6B and 6C includes passageways 395*b* and 396*b* which intersect passageway 394 and which distribute the air entrained catalyst to nozzles 342*a* and 342*b*, respectively. Air-catalyst passageways 395*b* and 396*b* are plugged at their respective ends opposite passageway 394. Tube 390, extending from the rearmost face of nozzle 340, forms an O-ring groove 391 and carries an O-ring 392. When the air-catalyst nozzle 340 is assembled to the head portion 324 of the gun body as shown in FIGS. 2–5, its tube 390 extends into the cavity 386 and O-ring 392 forms a seal between tube 390 and the cylindrical surface of head portion 324 forming cavity 386.

Nozzle assembly 18, and particularly liquid resin nozzle 330 and air-catalyst nozzle 340, are shown in greater detail in FIGS. 6 and 7. FIG. 6A is a cross-sectional view of the nozzle assembly through section 6A—6A of FIG. 6C. FIG. 6B is a cross-sectional view of the air-catalyst nozzle 340 taken along a plane at right angles to the plane of the cross-section of FIG. 6A. The plane of the cross-section of FIG. 6B corresponds with the plane of the cross-section of FIG. 8. The nozzle assembly 340 preferably has a diameter of about 1.5 inches. As indicated in FIG. 5, the threaded nut 360 fits over the subassembly comprising liquid resin nozzle 330, seal 333 and air-catalyst nozzle 340. Threaded nut 360 engages the front surface 343 of air-catalyst nozzle 340 and the subassembly is threaded onto the front of body 324, thereby forming a liquid seal between the central passageways of body portion 350, seal 333 and liquid resin nozzle 330 and directing the flow of resin to the liquid resin nozzle 330, where it is divided into an array of small, spaced streams by an array of small, spaced openings 201*a* as shown in FIG. 7. Preferably, liquid nozzle 330 has more than five small, spaced openings arranged in a two-dimensional distributed array. Still more preferably, liquid resin nozzle 330 has a large number of small spaced openings arranged in a two-dimensional distributed array, for example, more than ten. Such resin nozzles preferably have 20 or more openings in the array.

In the specific nozzle assembly 18, shown in FIG. 7, the liquid resin nozzle 330 has 33 small, spaced holes arranged in a two-dimensional distributed array. Liquid resin nozzle 330 is provided with a flow of resin at pressures on the order of 100–800 pounds per square inch. Each small hole has, for example, a diameter of about 0.010 inch, and the holes are, for example, spaced apart about 0.060 inch and form the flowing resin into 33 fine streams in a two-dimensional distributed array. Liquid resin nozzle 330 is of a type known in the art and may be provided with a variety of orifice sizes and arrangements. The resin nozzle orifices can have diameters in the range from 0.010 inch to 0.030 inch, and the resin nozzles can form spray patterns with included angles from about 15° to about 45°.

In accordance with the invention, air-catalyst nozzle 340 is provided adjacent liquid resin nozzle 330 and provides two sprays of catalyst entrained in air via nozzles 342*a* and 342*b* directed at the plurality of small, spaced streams of resin from liquid resin nozzle 330 from two opposite sides of the two-dimensional array of streams, and further provides two flows of compressed air via nozzles 341*a* and 341*b* on the other two opposing sides of the spaced array of resin streams. The two sprays of catalyst entrained in air uniformly break the plurality of small, spaced resin streams into resin particles and produce a substantially uniform mixture of resin and catalyst particles. The two flows of air from nozzles 341*a* and 341*b* at the other sides of the spaced array of resin streams entrap and contain vapors emitted from the resin streams and catalyst. In addition, the flows of air provide improved wetting of fibers when used to wet-out pre-deposited fibers and when used with a fiber chopper to deposit wetted reinforcing fibers on a substrate. Both such operations are useful in the manufacture of fiber-reinforced plastic articles, and the air-assisted containment of vapors emitted from the plural component materials provides a better working environment.

Thus, compressed air and catalyst flowing to cavity 386 flow into passageway 393 of pipe 390 and passageways 394, 395*b* and 396*a* (see FIGS. 6B and 6C) drilled into the main body of air-catalyst nozzle 340. As shown in FIG. 6C, passageways 395*b* and 396*b* intersect within the body of spray nozzle 340 with passageway 394 and are closed at the peripheral surfaces of the body. As shown in FIG. 6B, compressed air and catalyst are directed via passageways 397*a* and 397*b*, which intersect passageways 395*b* and 396*b*, respectively, to the plurality of air-catalyst spray nozzles 342*a* and 342*b*, respectively. The air-catalyst spray nozzles 342*a* and 342*b* direct the air-entrained catalyst at the spaced plurality of resin streams from the liquid resin nozzle 330 which is positioned in central opening 344 of air-catalyst nozzle 340, as shown in FIG. 7. The two flattened portions 344*a* and 344*b* (see FIGS. 4, 6C and 7) of central opening 344 ensure that the nozzle assembly 340 is properly aligned with the liquid resin nozzle 330. The air-catalyst nozzles 342*a* and 342*b* may be pressed into the body of nozzle assembly 340 or may be fastened therein by any convenient fastening method.

In the embodiments illustrated in FIGS. 6 and 7, the nozzle assembly 340 surrounds liquid resin nozzle 330 and the liquid resin nozzle is located within the opening 344 along the longitudinal center line of nozzle assembly 340. The air-catalyst spray nozzles 342*a* and 342*b* formed by the nozzle assembly are located on a plane, which corresponds to plane 6B—6B in FIG. 6C, that is perpendicular to and bisects a plane, which corresponds to plane 6A—6A in FIG. 6C, upon which lies the centers of air orifices 341*a* and 341*b*. As shown in FIG. 7, the air-catalyst spray nozzles 342*a* and 342*b* are located on the opposite sides of the two-dimensional array formed by the ends of the rows of holes 201 that form the small resin streams, and direct flows of compressed air and catalyst at an acute included angle "a" (FIG. 6B) in an expanding fan-like form, with respect to the spaced plurality of small resin streams, and impinge upon the resin streams a distance of from about five-tenths to about eight-tenths of an inch forwardly of the orifice of the liquid resin nozzle 330. Air-catalyst spray nozzles 342*a* and 342*b* can be equally spaced from the center line of the liquid resin nozzle 330 by a distance "c" of about three-eighths of an inch to about one-half of an inch and directed to form equal acute included angles "a" of about 25 to about 35 degrees with respect to the longitudinal center axis of the liquid resin nozzle 330.

As noted above, a flow of compressed air in the illustrated embodiments of FIGS. 6 and 7 is formed by two passageways 341*c*, 341*d* (FIG. 6A) parallel to both the longitudinal axis of the nozzle assembly and to each other. The two passageways are equally spaced from the central longitudinal axis of the liquid resin nozzle 330 a distance "e" of about three-tenths to about four-tenths of an inch. Air nozzles 341*a* and 341*b* are located centrally adjacent the outermost rows of holes 201 that form the small resin streams, preferably lying in a plane that perpendicularly bisects the plane extending through the centers of catalyst spray nozzles 342*a* and 342*b*.

In addition, as shown in FIGS. 6 and 7, a pair of cavities 346*a* and 346*b* may be formed in the front face 343 of air-catalyst nozzle assembly 340 around air orifices 341*a* and 341*b*, respectively. Cavities 346*a* and 346*b* are formed in the front face 343 in such a manner that they extend inwardly at an acute angle with respect to air passageways 341*c* and 341*d* (FIG. 6A), respectively, but in such a manner that there are no air nozzle surfaces forwardly of the air orifices 341*a* and 341*b* that lie within the imaginary extension of the air passageways 341*c* and 341*d*, and compressed air is directed forwardly and generally parallel to the spray axis, i.e., the axis generally parallel to the plurality of passageways 331. Cavities 346*a* and 346*b* tend to form low pressure areas adjacent the air orifices 341*a* and 341*b* which "soften" the edges of the compressed air jets projected from orifices 341*a* and 341*b* as the compressed air jets extend forwardly from the front face 343 of the air-catalyst nozzle 340. The acute angle "j" (FIG. 6A) formed by the central axis of cavities 346*a* and 346*b* and the longitudinal axis of air passageways 341*c* and 341*d* may vary; with the specific embodiment described above, effective operation can be obtained with cavities 346*a* and 346*b* lying at an angle "j" equal to about 20 degrees if the cavities have a diameter of about 0.138 inch and a depth of about 0.118 inch and the diameter of air passageways 341*c* and 341*d* is about 0.062 inch.

This invention provides a further improved embodiment, including the nozzle assembly 418 shown in FIGS. 9A–9D that can be employed with the system and method of this invention. Nozzle assembly 418 is similar to nozzle assembly 18 in that it comprises a nozzle assembly in which compressed air and liquid pressure are used in applying the plural component material. Nozzle assembly 418 comprises first liquid resin nozzle 330 for providing a plurality of small, spaced streams of resin, and a second air-catalyst nozzle 440 for dividing a flow of compressed air into a plurality of directed air flows and for dividing a flow of catalyst and compressed air into a plurality of directed catalyst-air sprays. Resin nozzle 330 and air-catalyst nozzle 440 interfit and are fastened to head portion 324 of the spray gun 17 in the same manner as illustrated in FIGS. 5–8 and described above for resin nozzle 330 and air-catalyst nozzle 340.

First liquid resin nozzle 330 of this further improved embodiment is identical in structure to liquid resin nozzle 330 discussed above, including a plurality of small openings 401 in a two-dimensional array. In this further embodiment, the flow of resin into applicator means 13 is directed from the central passageway 351 of body portion 350 (FIG. 5) through liquid resin nozzle 330 in nozzle assembly 418 which forms the resin flow into a plurality of small, spaced streams of resin flowing from holes 401 in a two-dimensional array. Second air-catalyst nozzle 440 surrounds resin nozzle 330 with a plurality of flow-forming nozzles and orifices.

The flow of catalyst-injected compressed air into applicator means 13 is directed through a plurality of spray nozzles 442*a* and 442*b* in nozzle assembly 418 which are configured and positioned so that the catalyst and compressed air will coact with the plurality of resin streams externally of the spraying means, simultaneously mix the resin and catalyst particles and assist in the application of the resin onto the substrate. In this further embodiment, as in air-catalyst nozzle 340 of the embodiment described above, air-catalyst nozzles 442*a* and 442*b* are located centrally on the sides of the two-dimensional array of resin nozzle 330 that are formed by the ends of the rows of holes 401, preferably on the plane which corresponds to plane 9C—9C in FIG. 9A, and the flows of air and catalyst are directed at the two-dimensional array of small resin streams from their central location adjacent the sides of the two-dimensional array formed by the ends of the rows to assist in the atomization of the resin and to mix resin and catalyst. Unlike the expanding fan-like spray "patterns" created by the air-catalyst nozzles 342*a* and 342*b* of nozzle 340 described above, the air-catalyst mixtures from nozzles 442*a* and 442*b* of nozzle 440 are directed at the resin streams in expanding conical-shaped spray patterns.

Also, in this further embodiment, as in air catalyst nozzle 340 of the embodiment described above, the air-catalyst nozzle 440 further directs a plurality of flows of air from air orifices 441*a* and 441*b* that are located centrally on the sides of the two-dimensional array of resin nozzle 330 that are formed by the outermost rows of holes 401, preferably on the plane that corresponds to plane 9B—9B in FIG. 9A and bisects the plane 9C—9C of FIG. 9A, and the plurality of air flows from air orifices 441*a* and 441*b* capture and contain resin and catalyst particles and vapors.

However, unlike air-catalyst nozzle 340, air-catalyst nozzle 440 includes a plurality, preferably four, small air holes 450*a*–450*d* arranged between the plurality of air-catalyst nozzles 442*a* and 442*b* and the resin nozzle 330. Preferably, the four air holes 450*a*–450*d* are located around resin nozzle 330, substantially equally spaced between the air-catalyst nozzles 442*a*, 442*b* and the air orifices 441*a*, 441*b*. For example, as shown in FIG. 9A, air hole 450*a* is located substantially equidistance between air orifice 441*a* and air-catalyst nozzle 442*b*; air hole 450*b* is located substantially equidistance between air-catalyst nozzle 442*b* and air orifice 441*b*, etc. Flows of air are directed from air holes 450*a*–450 forwardly from the front face 443 of the air-catalyst nozzle 440 and between the flows of air and catalyst from nozzles 442*a* and 442*b* and the two-dimensional array of resin flows from holes 401 of resin nozzle 330. The air flows from air holes 450*a*–450*d* are at a very low velocity, substantially lower than the flow velocities of the air-catalyst from nozzles 442*a* and 442*b* and of the containment air from air orifices 441*a* and 441*b*. The low velocity flows of air from air holes 450*a*–450*b* inhibit the accumulation of mixed resin and catalyst on the face 443 of air-catalyst nozzle 440. An accumulation of mixed resin and catalyst in the face 443 of air-catalyst nozzle 440 can harden and interfere with the proper operation of the system.

When the nozzle assembly 418 is used in system 10 of this invention, the connections for resin, catalyst and compressed air are arranged and operate in the same manner as described above in relation to nozzle assembly 18. Thus, the further embodiment of this invention including nozzle assembly 418 requires no other changes in the system or its components. Accordingly, when trigger 322 of the spray gun is pulled rearwardly, resin flows under the influence of pressure imparted by pump 23 through passageway 370, cavity 369, passageway 365, annular cavity 358, openings 359, central passageway 351, liquid resin nozzle 330 and the openings 401 therein.

As indicated above, liquid resin nozzle 330 includes a plurality of interior passageways (not shown) leading to openings 401 to force the resin to flow into a plurality of small, spaced streams projected from the nozzle 330 in a two-dimensional array, and preferably in an expanding pattern. While this plurality of interior passageways is not shown in FIG. 9, the passageways are identical to the interior passageways of liquid resin nozzle 330 shown in FIG. 5. Accordingly, liquid resin nozzle 330 preferably has more than five small, spaced openings arranged in a two-dimensional distributed array. Still more preferably, liquid resin nozzle 330 has a large number of small spaced openings arranged in a two-dimensional distributed array, for example, more than about twenty. Most preferably, liquid resin nozzle 330 has 33 small, spaced holes arranged in a two-dimensional distributed array. Liquid resin nozzle 330 is provided with a flow of resin at pressures on the order of 100–800 pounds per square inch. Each small hole has, for example, a diameter of about 0.010 inch to about 0.020 inch and the holes are, for example, spaced apart about 0.060 inch and form the flowing plural component material into 33 fine streams in a two-dimensional distributed array. As indicated above, liquid resin nozzle 330 is of a type known in the art and may be provided with a variety of hole sizes and arrangements.

As also indicated above, nozzle assembly 418 is assembled onto the head portion 324 of spray gun body 17 in the same manner as nozzle assembly 18, shown in FIG. 5. Thus, liquid resin nozzle 330 is held onto head portion 324 of the spray gun body by air-catalyst nozzle 440 and a threaded retainer nut 360. As described above, retainer nut 360 includes threaded portion 361 at its rear which threads onto threaded portion 362 at the forward end of head portion 324, and retainer nut 360 forms at its forward position an inwardly projecting flange 363 which engages the front face 443 of air-catalyst nozzle 440, urging the entire nozzle assembly 418 rearwardly and tightly against the front face 326 of head portion 324.

Air-catalyst nozzle 440 is formed with a central opening 444 which is shaped to include two flat surfaces 444*a*, 444*b* and two curved surfaces 444*c* and 444*d* (FIGS. 9A and 9B) that fit around liquid resin nozzle 330. A rearwardly facing flange 445 of nozzle 440 (FIGS. 9B and 9C) is formed around central opening 444. As the retaining nut 360 is threaded onto the head portion 324 of the spray gun 17 and its rearwardly facing flange 363 engages the front face 443 of air-catalyst nozzle 440 and urges the nozzle 440 rearwardly, flange 445 of nozzle 440 presses liquid resin nozzle 330 rearwardly into engagement with sealing means 333 and body portion 350 as shown in FIG. 5.

As also shown in FIG. 5, a sealing means 333 will sealingly engage liquid resin nozzle 330 and body portion 350. Thus, as retaining nut 360 is threaded onto head portion 324 of the spray gun body 17, nut 360 simultaneously fastens the air-catalyst nozzle 440 and liquid resin nozzle 330 to the head portion 324 of the spray gun 17 and provides an effective seal between liquid resin nozzle 330 and air-catalyst nozzle 440 and, by means of seal means 333, between liquid resin nozzle 330 and body portion 350.

As noted above, body portion 350 includes a plurality of passageways 376 and when positioned in the cavity formed in head position 324, it permits the delivery of a flow of compressed air to the plurality of air orifices 441*a* and 441*b* in the front face 443 of the air-catalyst nozzle 440. The central cavity 327 (FIG. 8) of head portion 324 includes rearward portion 375, and the plurality of passageways 376 of body portion 350 extend forwardly from portion 375 and open into annular air cavity 377 formed between body portion 350, front face 326 of head portion 324 of the applicator and air-catalyst nozzle 440. A plurality of air passageways 441*c*, 441*d* (FIG. 9B) extending to air orifices 441*a* and 441*b* and a plurality of air holes 450*a*–450*d* communicate with annular air cavity 377.

As described above, compressed air is directed through passageways, which are not shown, in the spray gun body 17 from opening 319 (FIGS. 2 and 4) to the interface between head portion 324 and the front portion 325 of the spray gun body. As shown in FIG. 8, passageway 378 intersects a passageway 379 in head portion 324 which extends rearwardly to the interface between head portion 324 and the front portion 325 of spray gun body 17. When trigger 322 is operated, the compressed air flows from source 27 and compressed air control 39 (FIG. 1) through conduit 42, opening 319, the passageways in gun body 17 (not shown), passageway 379, passageway 378, cavity 375, the plurality of passageways 441*c* and 441*d* (FIG. 9B) formed in air-catalyst nozzle 440 and from the plurality of air orifices 441*a* and 441*b*.

Concurrently with the compressed air being directed forwardly of the nozzle assembly 418 from orifices 441*a* and 441*b*, low velocity flows of air are also directed from the annular air cavity 377 through the plurality of passageways 450*a* –*d* (FIGS. 9A–C) and from the plurality of small orifices disposed on the front face 443 of air-catalyst nozzle 440 to inhibit the accumulation thereon of plural-component material.

As described above in relation to the delivery of a flow of air-entrained catalyst to the nozzle assembly 418, cavity 380 forms a central cavity 383 which communicates with passageway 384 (FIG. 5). Passageway 384 extends upwardly through head portion 34 of the spray gun body 17 and extends rearwardly through tube 372 shown in FIGS. 3 and 4 to opening 315 and catalyst injection means 31. When trigger 322 is operated, catalyst particles and air flow, as described above, through injection means 31, orifice 315 at the rear of the spray gun body 317, tube 372 (FIGS. 1, 3 and 4), passageway 384 and through passageway 385 to cavity 386. With air-catalyst nozzle 440 in the position on the forward portion 324 of the spray gun 17, the air-entrained catalyst is directed into a passageway in tube 490 (FIGS. 9C and 9D) at the rear 443' of the air-catalyst nozzle 440 and into air-catalyst passageway 494.

Tube 490, extending from the rearmost face 443' of nozzle 440, forms an O-ring groove and carries an O-ring similar to groove 391 and ring 392 described above in relation to air-catalyst nozzle 340. When the air-catalyst nozzle 440 is assembled to the head portion 324 of the gun body 17 as shown in FIGS. 2–5, tube 490 extends into the cavity 386 and the O-ring forms a seal between tube 490 and the cylindrical surface of head portion 324 forming cavity 386. Compressed air and catalyst flowing to cavity 386 flow into a passageway (not shown) of pipe 490 and passageways 494, **495*b* and 496*a* (see FIGS. 9A, 9C and 9D) drilled into the main body of air-catalyst nozzle 440. As shown in FIGS. 9A and 9C, passageways 495*b* and 496*b* intersect within the body of nozzle 440 with passageway 494 and are closed at the peripheral surfaces of nozzle 440 by, for example, plugs 495 *b'* and 496*b'* (FIGS. 9C and 9D). As shown in FIG. 9C, compressed air and catalyst are directed via passageways 497*a* and 497*b*, which intersect passageways 495*b* and 496*b*, respectively, to the plurality of air-catalyst spray nozzles 442*a* and 442*b*, respectively. The air-catalyst spray nozzles 442*a* and 442*b* direct expanding conical flows of air-entrained catalyst at the spaced plurality of resin streams from the liquid resin nozzle 330, which is positioned in central opening 444 of air-catalyst nozzle 440, as shown in FIG. 9A. The two flattened portions 444*a* and 444*b* of central opening 444 ensure that the nozzle assembly 440 is properly aligned with respect to the liquid resin nozzle 330**.

Air-catalyst nozzles **442*a* and 442*b* may be pressed into the body of nozzle assembly 440 or may be fastened therein by any convenient fastening method. Unlike nozzles 342*a* and 342*b* of air catalyst nozzle 340, nozzles 442*a* and 442*b* have forward surfaces that are substantially flush with the forward face 443 of air catalyst nozzle 440 and include an orifice-forming portions which have slightly elliptical openings to form expanding conical air-catalyst sprays. The elliptical orifices of nozzles 442*a* and 442*b* are preferably substantially flush with the forward face 443 of nozzle 440. Alternatively, no nozzle inserts 442*a*, 442*b* may be employed and passageways 497*a* and 497*b* can extend forwardly to the front face 443 of nozzle 440 and be formed with appropriate spray-forming surfaces adjacent the front face 443 of nozzle 440**.

In the embodiment illustrated in FIGS. 9A–D, the nozzle assembly 440 surrounds liquid resin nozzle 330, and nozzle 330 is located within the opening 444 at the longitudinal center line of nozzle assembly 440 (FIG. 9A). The air-catalyst spray nozzles **442*a* and 442*b* are located on the plane, which corresponds to plane 9C—9C in FIG. 9A, that is perpendicular to and bisects the plane which corresponds to plane 9B—9B in FIG. 9A, that extends through the centers of air orifices 441*a* and 441*b***.

The air-catalyst spray nozzles **442*a* and 442*b* direct the flows of compressed air and catalyst at an acute, included angle "c" (FIG. 9C) with respect to the spaced plurality of small resin streams and impinge upon the resin streams at a distance of from about five-tenths to about eight-tenths of an inch forwardly of the orifice of the liquid resin nozzle 330. Such orientation, in cooperation with air orifices 450*a–d*, inhibits a troublesome accumulation of multi-component particles on the face of the nozzle assembly 418**.

Air-catalyst spray nozzles **442*a* and 442*b* can be equally spaced from the center line of the liquid resin nozzle 330 by a distance of about three-eighths of an inch to about one-half of an inch and directed to form equal acute included angles "c" (FIG. 9C) of about 25 to 35 degrees with respect to the longitudinal center axis of the liquid resin nozzle 330**.

As noted above, a flow of compressed air in the embodiment illustrated in FIGS. 9A–9D is formed by two passageways **441*c* and 441*d* disposed parallel to both the longitudinal axis of the nozzle assembly 418 and to each other. The two passageways are equally spaced from the central longitudinal axis of the liquid resin nozzle 330 a distance of about three-tenths to about four-tenths of an inch and lie in the plane, which corresponds to plane 9B—9B in FIG. 9A and perpendicularly bisects the plane that extends through the centers of the catalyst spray nozzles 442*a* and 442*b***.

In addition, as shown in FIGS. 9A and 9B, a pair of cavities **446*a* and 446*b* may be formed in the front face 443 of air-catalyst nozzle 440 around air orifices 441*a* and 441*b*, respectively. Cavities 446*a* and 446*b* are formed in the front face 443 in such a manner that they extend inwardly at an acute angle "d" (FIG. 9B) with respect to air passageways 441*c* and 441*d*, respectively, but in such a manner that there are no air nozzle surfaces forwardly of the air orifices 441*a* and 441*b* that lie within the imaginary extension of the air passageways 441*c* and 441*d* and compressed air is directed forwardly and generally parallel to the spray axis, i.e., the axis generally parallel to the plurality of passageways 431. Cavities 446*a* and 446*b* tend to form low pressure areas adjacent the air orifices 441*a* and 441*b* which "soften" the edges of the compressed air jets projected from orifices 441*a* and 441*b* as the compressed air jets project forwardly from the front face 443 of the air-catalyst nozzle 440. The acute angle "d" (FIG. 9B) formed by the central axis of cavities 446*a* and 446*b* and the longitudinal axis of air passageways 441*c* and 441*d* may vary. In the specific embodiment described herein, however, effective operation can be obtained with cavities 446*a* and 446*b* lying at an angle "d" equal to about 20 degrees if the cavities have a diameter of about 0.138 inch, a depth of about 0,118 inch, and the diameter of air passageways 441*c* and 441*d*** is about 0.062 inch.

Each of the four air holes **450*a*–450*b* is formed by drilling through the body of the air-catalyst nozzle 440 between its front face 443 and the rear surface that forms annular air cavity 377. In the preferred embodiment of air-catalyst nozzle 440 shown in FIGS. 9A–9D, air holes 450*a*–450*d* have a diameter of about 0.052 inches. As indicated in FIG. 9A, the pair of air holes 450*a* and 450*b* and the pair of air holes 450*c* and 450*d* are located, respectively, in a pair of planes, each of which is parallel to the plane 9B—9B and spaced on each side thereof a distance of about 0.239 inches. In addition, the pair of air holes 450*a* and 450*c* and the pair of air holes 450*b* and 450*d*** are located, respectively, in a pair of planes, each of which is parallel to the plane 9C—9C and spaced on each side thereof a distance of about 0.246 inches.

As shown and described above, the invention provides a plural component application system, including a liquid nozzle having a plurality of small, spaced passageways distributed in a two-dimensional array about the geometric center of said liquid nozzle and adapted to project a plurality of small, spaced streams of a first plural component material, such as resin, forward of the liquid nozzle; and a second nozzle body forming an opening in its face permitting the body to be positioned adjacent the liquid nozzle and providing a plurality of spray nozzles equally spaced on opposite sides of said opening and adapted to direct a plurality of air-carried sprays of a second plural component, such as catalyst, inwardly at said plurality of small spaced streams of said first plural component material and also providing a plurality of air passageways equally spaced between said plurality of spray nozzles and adapted to direct a plurality of flows of compressed air forwardly of the body, generally parallel to each other and perpendicular to the face of the second nozzle body.

In a preferred embodiment of the invention, as shown in FIGS. 9A–9D, the plurality of small, spaced streams formed by the liquid nozzle passageways are distributed in a two-dimensional array having a plurality of rows of passageways, with each of the rows having a greater number of passageways than the number of rows and with the two-dimensional array having a length along said rows greater than its width across said rows. In such a preferred embodiment, the spray nozzles for the second component are located centrally adjacent the sides of the two-dimensional array formed by the ends of the rows of holes and are adapted to direct the spray of second plural component (e.g., catalyst) material along the rows of resin streams, and the plurality of passageways for containment air are generally centrally located adjacent the outermost rows, preferably on a plane that bisects the plane on which the spray nozzles are located. The spray nozzles are adapted to form the sprays of second plural component material into expanding conical-shaped sprays of particles of the second plural component material. Such a preferred embodiment further includes a plurality of air holes arranged between the spray nozzles and liquid nozzle and adapted to direct low flows of air forwardly to inhibit or prevent an accumulation of mixed plural component material on the nozzle assembly.

The invention thus provides a further useful method of application of mixed plural component material by providing a flow of resin, dividing the flow into a spaced array of small streams of resin, providing flows of catalyst entrained in air directed at the spaced array of a plurality of small streams of resin; breaking the plurality of small streams of resin into resin particles and mixing the resin particles with catalyst; providing a containment flow of air adjacent to but spaced from the spaced array of resin streams and from the flows of catalyst entrained in air to capture and contain vapors emitted from the resin and catalyst particles; and providing a deposit-inhibiting flow of air to prevent plural-component material from accumulating on the face of the nozzle assembly.

The application system of this invention can be advantageously applied not only to resin-catalyst systems for the formation of fiber reinforced plastic products such as boats, shower stalls and the like, but to other plural component systems for industrial applications as well. Such systems provide substantially improved plural component application and are less expensive to manufacture, operate and maintain. Systems of this invention are also easier and safer to use through their improved operation.

While the apparatus and method described above constitutes a presently preferred embodiment, the invention can take many other forms. Accordingly, it should be understood that the invention is to be limited only insofar as is required by the scope of the following claims.

I claim:

1. A nozzle assembly for use in a plural component application system, comprising:

a liquid nozzle having a plurality of small, spaced liquid passageways in a two-dimensional array about the geometric center of said liquid nozzle and adapted to project a plurality of small, spaced streams of a first plural component material forward of the liquid nozzle; and a body forming an opening in its face permitting the body to be positioned adjacent the liquid nozzle, said body having a plurality of spray nozzles equally spaced on a first plane on opposite sides of said opening and adapted to direct a plurality of conical-shaped sprays of a second plural component and air inwardly at said plurality of small spaced streams of said first plural component material, said body also having a first plurality of air passageways on a second plane between said plurality of air-second plural component spray nozzles and equally spaced on opposite sides of said opening and adapted to direct a first plurality of flows of compressed air forwardly of the body for downstream containment of the plural components.

2. The nozzle assembly of claim 1 wherein said plurality of small spaced liquid passageways are distributed in a two-dimensional array having a plurality of rows of passageways, with each of the rows having a greater number of passageways than the number of rows, said two-dimensional array having a length along said rows greater than its width across said rows.

3. The nozzle assembly of claim 2 wherein said plurality of small spaced liquid passageways are distributed in a two-dimensional array having five rows with each row having at least six passageways.

4. The nozzle assembly of claim 1 wherein each of said first plurality of air passageways is surrounded by a cavity at the front face of the nozzle.

5. The nozzle assembly of claim 4 wherein the central axis of the cavities lie at an acute angle with respect to the central axis of the air passageways.

6. The nozzle assembly of claim 5 wherein the cavities have an inside diameter of about 0.138 inch and a depth of about 0.118 inch and their central axes lie at an angle of about 20° with respect to the central axes of the air passageways.

7. The nozzle assembly as in claim 1 wherein each of said second plurality of air passageways has a diameter substantially smaller than the diameters of the first plurality of air passageways and the passageways leading to the spray nozzles.

8. The nozzle assembly as in claim 1 wherein said plurality of spray nozzles includes two spray nozzles equally spaced on said first plane on opposite sides of said opening, wherein said first plurality of air passageways includes two passageways equally spaced on said second plane on opposite sides of said opening, said second plane of said first plurality of air passageways being perpendicular to and bisecting the first plane of said two spray nozzles; and wherein said second plurality of air passageways includes four passageways spaced equally between said two spray nozzles and said first two air passageways.

9. The nozzle assembly as in claim 1 wherein the central axes of said second plurality of air passageways lie generally parallel to each other and perpendicular to the face of said body to direct said second plurality of flows of compressed air forwardly of the body generally parallel to each other and perpendicular to the face of said body.

10. A nozzle assembly for use in a plural component application system, comprising:

a liquid nozzle having a plurality of small, spaced liquid passageways in a two-dimensional array about the geometric center of said liquid nozzle and adapted to project a plurality of small, spaced streams of a first plural component material forward of the liquid nozzle; and a body forming an opening in its face permitting the body to be positioned adjacent the liquid nozzle, said body having a plurality of spray nozzles equally spaced on a first plane on opposite sides of said opening and adapted to direct a plurality of sprays of a second plural component in air inwardly at said plurality of small spaced streams of said first plural component material, said spray nozzles being adapted to direct the spray of second component material along the rows, said plurality of air passageways being generally centrally located adjacent the center of the outermost rows, said body also having a first plurality of air passageways on a second plane between said plurality of air-second plural component spray nozzles and equally spaced on opposite sides of said opening and adapted to direct a first plurality of flows of compressed air forwardly of the body for containing the plural components, said body also having a second plurality of air passageways arranged between said liquid nozzle and said plurality of spray nozzles and adapted to direct a second plurality of flows of compressed air forwardly of the body for inhibiting the accumulation of said plural component materials on the face of said nozzle assembly.

11. The nozzle assembly of claim 10 wherein said spray nozzles are adapted to form the sprays of second plural component material into expanding conical-shaped sprays.

12. A method of applying a plural component material to a substrate, comprising:

delivering a flow of a first component of said plural component material to an applicator means;

delivering a flow of a second component of said plural component material to said applicator means;

delivering a flow of compressed air to said applicator means;

forming said first component into a plurality of small, spaced streams of said first plural component distributed in a two-dimensional array extending forwardly from the applicator means from a first location;

mixing said flow of second component with said flow of compressed air;

forming the mixture of compressed air and second component into a plurality of conically-shaped sprays of second component entrained in compressed air and directing the plurality of conically-shaped sprays of air-entrained second component at the plurality of small, spaced streams of said first component; and directing a first plurality of flows of compressed air substantially parallel to said small, spaced streams from a plurality of locations closely adjacent said plurality of small, spaced streams of first component material for capturing and containing emissions of first and second components downstream of the intersection of the first and second components.

13. The method of claim 12 wherein said plurality of small, spaced streams of said first component is distributed from said first location in an array of a plurality of rows, each row having a plurality of passageways with the number of passageways in each row exceeding the number of rows and having a length dimension greater than the height of the array.

14. The method of claim 12 wherein the rates of flow of said second plurality of air flows is substantially less than the rates of flow said first plurality of air flows.

15. A method of applying a plural component material to a substrate, comprising:

delivering a flow of a first component of said plural component material to an applicator means;

delivering a flow of a second component of said plural component material to said applicator means;

delivering a flow of compressed air to said applicator means;

forming said first component into a plurality of small, spaced streams of said first plural component distributed in a two-dimensional array extending forwardly from the applicator means from a first location, said two-dimensional array including a plurality of rows, each row having a plurality of passageways with the number of passageways in each row exceeding the number of rows and having a length dimension greater than the height of this array;

mixing said flow of second component with said flow of compressed air;

forming the mixture of compressed air and second component into a plurality of sprays of second component entrained in compressed air and directing the plurality of sprays of air-entrained second component at the plurality of small, spaced streams of said first component;

directing a first plurality of flows of compressed air substantially parallel to said small, spaced streams from a plurality of locations closely adjacent said plurality of small, spaced streams of first component material for containing emissions of first and second components, said first plurality of air flows being directed in two separate flows of compressed air from a pair of opposed locations generally adjacent the centers of the outermost rows of the two-dimensional array; and directing a second plurality of flows of compressed air forwardly of the body for inhibiting the accumulation of first and second components on the face of said nozzle assembly.

16. A method of applying a plural component material to a substrate, comprising:

delivering a flow of a first component of said plural component material to an applicator means;

delivering a flow of a second component of said plural component material to said applicator means;

delivering a flow of compressed air to said applicator means;

forming said first component into a plurality of small, spaced streams of said first plural component distributed in a two-dimensional array extending forwardly from the applicator means from a first location, said two-dimensional array including a plurality of rows, each row having a plurality of passageways with the number of passageways in each row exceeding the number of rows and having a length dimension greater than the height of this array;

mixing said flow of second component with said flow of compressed air;

forming the mixture of compressed air and second component into a plurality of sprays of second component entrained in compressed air and directing the plurality of sprays of air-entrained second component at the plurality of small, spaced streams of said first component, said plurality of sprays of the second component including two separate sprays of air and second component directed at the plurality of small, spaced streams of the first component from a pair of second locations equally spaced from and centrally located on the opposite sides of small, spaced streams of said first component that are formed by the ends of the rows;

directing a first plurality of flows of compressed air substantially parallel to said small, spaced streams from a plurality of locations closely adjacent said plurality of small, spaced streams of first component material for containing emissions of first and second components, said first plurality of air flows being directed in two separate flows substantially parallel to the small, spaced streams of said first component from a pair of third locations equally spaced on the opposite sides of the small, spaced streams of said first component that are formed by the outermost rows, and directing a second plurality of flows of compressed air forwardly of the body for inhibiting the accumulation of first and second components on the face of said nozzle assembly, said second plurality of air flows being directed in four separate flows that are substantially parallel to the small, spaced streams of said first component and generally parallel to each other and being substantially equally spaced between the second locations of said sprays of second component and said third locations of said first plurality of air flows.

17. Means for spraying a plural component material, comprising:

a first delivery means for providing a flow of a first component;

a second delivery means for providing a flow of a second component;

an air delivery means for providing a flow of compressed air;

an injection means for mixing said flow of second component with a flow of air from said air delivery means;

a sprayer for mixing said first and second components and directing mixed plural component material from the sprayer;

said sprayer comprising a liquid nozzle having a plurality of small, spaced liquid passageways in a two-dimensional array about the geometric center of said liquid nozzle and adapted to project a plurality of small, spaced streams of the first component forwardly of the liquid nozzle; and a combined nozzle assembly adjacent the liquid nozzle, said combined nozzle assembly having a plurality of second component-air nozzles spaced on a first plane on opposite sides of said liquid nozzle and adapted to direct a plurality of conically-shaped sprays of second component and air inwardly at said plurality of small spaced streams of said first plural component material, said combined nozzle assembly also having a first plurality of air passageways spaced between said plurality of second component-air nozzles and on opposite sides of said liquid nozzle for directing a first plurality of flows of compressed air forwardly of the body for downstream containment of the plural components.

18. The means of claim 17 and further including alignment means on said liquid nozzle and said combined nozzle assembly for automatically aligning said liquid nozzle and combined nozzle assembly when said liquid nozzle and said combined nozzle assembly are assembled.

19. A nozzle assembly for use in a plural component application system, comprising:

a liquid nozzle having a plurality of small, spaced liquid passageways in a two-dimensional array about the geometric center of said liquid nozzle, said passageways being adapted to project a plurality of small, spaced streams of a first plural component material forwardly of the liquid nozzle; and a body forming an opening in its face permitting the body to be positioned adjacent the liquid nozzle, said body having a plurality of spray nozzles equally spaced on opposite sides of said opening and adapted to direct a plurality of generally conically-shaped sprays of a second plural component and air inwardly at said plurality of small spaced streams of said first plural component material, said body also having a plurality of air passageways equally spaced between said plurality of spray nozzles and adapted to direct a plurality of flows of compressed air forwardly of the body, generally parallel to each other and perpendicular to the face of the body for downstream containment of the mixed plural component spray.

20. The nozzle assembly of claim 19 wherein said plurality of small spaced passageways are distributed in a two-dimensional array having a plurality of rows of passageways, with each of the rows having a greater number of passageways than the number of rows, said two-dimensional array having a length along said rows greater than its width across said rows.

21. The nozzle assembly of claim 20 wherein said plurality of small spaced liquid passageways are distributed in a two-dimensional array having five rows with each row having at least six passageways.

22. The nozzle assembly of claim 19 wherein each of said air passageways is surrounded by a cavity at the front face of the nozzle.

23. The nozzle assembly of claim 22 wherein the central axes of the cavities lie at an acute angle with respect to the central axis of the air passageways.

24. The nozzle assembly of claim 23 wherein the cavities have an inside diameter of about 0.138 inch and a depth of about 0.118 inch and their central axes lie at an angle of about 20° with respect to the central axes of the air passageways.

25. A nozzle assembly for use in a plural component application system, comprising:

a liquid nozzle having a plurality of small, spaced liquid passageways in a two-dimensional array about the geometric center of said liquid nozzle, said passageways being adapted to project a plurality of small, spaced streams of a first plural component material forwardly of the liquid nozzle; and a body forming an opening in its face permitting the body to be positioned adjacent the liquid nozzle, said body having a plurality of spray nozzles equally spaced on opposite sides of said opening and adapted to direct a plurality of generally conically-shaped sprays of a second plural component and air inwardly at said plurality of small spaced streams of said first plural component material, said spray nozzles being adapted to direct the spray of second plural component material along the rows and said plurality of air passageways being generally equally spaced from the center of the two-dimensional array, said body also having a plurality of air passageways equally spaced between said plurality of spray nozzles and adapted to direct a plurality of flows of compressed air forwardly of the body, generally parallel to each other and perpendicular to the face of the body.

26. The nozzle assembly of claim 25 wherein said spray nozzles are adapted to form the sprays of second plural component material into sprays expanding into the sides of the two-dimensional array formed by the ends of the rows.

27. A method of applying a plural component material, comprising:

delivering a flow of a first component of said plural component material to an application means;

delivering a flow of a second component of said plural component material to said application means;

delivering a flow of compressed air to said application means;

forming said first component into a plurality of small, spaced streams of said first component distributed in a two-dimensional array extending from the application means;

mixing said flow of second component with said flow of compressed air;

forming the mixture of compressed air and second component into a plurality of generally conically-shaped sprays of second component in compressed air and directing the plurality of sprays of second component in compressed air at the plurality of small, spaced streams of said first component; and directing a plurality of flows of compressed air substantially parallel to said small, spaced streams from a plurality of locations closely adjacent said plurality of small, spaced streams of first component material to contain the mixed plural components downstream of the intersection of the first and second components, wherein particles of said first and second components are substantially prevented from escaping application and are mixed as applied.

28. The method of claim 27 wherein said plurality of small, spaced streams of first component are distributed in an array of a plurality of rows, each row having a plurality of passageways with the number of passageways in each row exceeding the number of rows and having a length dimension greater than the height of the array.

29. A method of applying a plural component material, comprising:

delivering a flow of a first component of said plural component material to an application means;

delivering a flow of a second component of said plural component material to said application means;

delivering a flow of compressed air to said application means;

forming said first component into a plurality of small, spaced streams of said first component distributed in a two-dimensional array extending from the application means, the array having a plurality of rows, each row having a plurality of passageways with the number of passageways in each row exceeding the number of rows and having a length dimension greater than the height of the array, mixing said flow of second component with said flow of compressed air;

forming the mixture of compressed air and second component into a plurality of generally conically-shaped sprays of second component in compressed air and directing the plurality of sprays of second component in compressed air at the plurality of small, spaced streams of said first component; and directing a plurality of flows of compressed air substantially parallel to said small, spaced streams from a plurality of locations closely adjacent said plurality of small, spaced streams of first component material, said plurality of air flows being directed in two flows of compressed air from a pair of opposed locations that lie on a line generally passing through the centers of the rows of a plurality of small, spaced streams, wherein particles of said first and second components are substantially prevented from escaping application and are mixed as applied.

30. A method of applying a plural component material, comprising:

delivering a flow of a first component of said plural component material to an application means;

said application means comprising a nozzle body having a central opening at its longitudinal center line in which a means forming said plurality of small, spaced streams of first component is positioned, two spray orifices being equally spaced from and on opposite sides of the longitudinal center line of the nozzle body for directing said plurality of flows of second component in compressed air at the ends of the plurality of rows of small spaced streams of the second component, and two air orifices being positioned to direct the plurality of flows of compressed air forwardly of the nozzle body and generally parallel to its longitudinal center line, delivering a flow of a second component of said plural component material to said application means;

delivering a flow of compressed air to said application means;

forming said first component into a plurality of small, spaced streams of said first component distributed in a two-dimensional array extending from the application means, the array having a plurality of rows, each row having a plurality of passageways with the number of passageways in each row exceeding the number of rows and having a length dimension greater than the height of the array, mixing said flow of second component with said flow of compressed air;

forming the mixture of compressed air and second component into a plurality of generally conically-shaped sprays of second component in compressed air and directing the plurality of sprays of second component in compressed air at the plurality of small, spaced streams of said first component; and directing a plurality of flows of compressed air substantially parallel to said small, spaced streams from a plurality of locations closely adjacent said plurality of small, spaced streams of first component material, wherein particles of said first and second components are substantially prevented from escaping application and are mixed as applied.

31. The method of claim 30 wherein each of said air orifices for directing a flow of compressed air is surrounded by a cavity.

32. A nozzle assembly for use in a plural component application system, comprising:

a liquid nozzle having a plurality of small, spaced liquid passageways in a two-dimensional array about the geometric center of said liquid nozzle, said passageways being adapted to project a plurality of small, spaced streams of a first plural component material forwardly of the liquid nozzle in a generally rectangular spray pattern having a pair of length edges and a pair of width edges, the length edges being longer than the width edges, a body forming an opening in its face permitting the body to be positioned adjacent the liquid nozzle, first means coupled to the body for forming a plurality of generally conical-shaped sprays of air and a second plural component material and directing the plurality of conical-shaped sprays at the width edges of the first plural component material spray pattern adjacent the liquid nozzle outlet to combine the first and second plural component materials, and second means coupled to the body for forming a plurality of air flows and directing the plurality of air flows for downstream containment of the combined flows of first and second plural components.

* * * * *

UNITED STATES PATENT AND TRADEMARK OFFICE

CERTIFICATE OF CORRECTION

PATENT NO. : 5,549,246

DATED : August 27, 1996

INVENTOR(S) : Timothy S. Kukesh

It is certified that error appears in the above-indentified patent and that said Letters Patent is hereby corrected as shown below:

In Col. 13, line 15, after "450", insert --d--.

In Col. 14, line 67, delete "450a -d" and insert therefor --450a-d--.

In Col. 15, line 52, after "include", delete "an".

In Col. 16, line 53, delete "0,118", and insert therefor --0.118--.

In Col. 16, line 56, delete "450a-450b" and insert therefor --450a-450d--.

In Col. 20, line 13, between "flow" and "said", insert --of--.

Signed and Sealed this

Twelfth Day of August, 1997

Bruce Lehman

*Attest:*

BRUCE LEHMAN

*Attesting Officer*

*Commissioner of Patents and Trademarks*